US010136488B1

(12) United States Patent
Kwon et al.

(10) Patent No.: US 10,136,488 B1
(45) Date of Patent: Nov. 20, 2018

(54) LED DIMMING

(71) Applicant: Linear Technology Holding, LLC, Norwood, MA (US)

(72) Inventors: Dongwon Kwon, San Jose, CA (US); Joshua William Caldwell, Los Gatos, CA (US)

(73) Assignee: Linear Technology Holding, LLC, Norwood, MA (US)

( * ) Notice: Subject to any disclaimer, the term of this patent is extended or adjusted under 35 U.S.C. 154(b) by 0 days.

(21) Appl. No.: 15/726,154

(22) Filed: Oct. 5, 2017

(51) Int. Cl.
*H05B 33/08* (2006.01)
*H05B 37/02* (2006.01)

(52) U.S. Cl.
CPC ..... *H05B 33/0845* (2013.01); *H05B 33/0818* (2013.01); *H05B 33/0887* (2013.01)

(58) Field of Classification Search
CPC H05B 33/08; H05B 33/0845; H05B 33/0818; H05B 33/0848; H05B 33/0851; H05B 33/086; H05B 37/02
See application file for complete search history.

(56) References Cited

U.S. PATENT DOCUMENTS 5,189,419 A * 2/1993 Lyden ..... H03M 3/35 341/143
6,646,848 B2 11/2003 Yoshida et al.
7,276,863 B2 10/2007 Lee et al.
7,511,437 B2 3/2009 Lys et al.
7,518,525 B2 4/2009 Chou
7,710,084 B1 * 5/2010 Guo ..... G01R 19/003 323/224
8,058,810 B2 11/2011 Chen et al.
8,179,110 B2 5/2012 Melanson
8,294,388 B2 10/2012 Wong et al.
8,456,106 B2 6/2013 Mednik et al.
8,710,819 B2 * 4/2014 Chen ..... G05F 1/561 323/285
8,810,157 B2 8/2014 Del Carmen, Jr.
8,975,831 B1 3/2015 Szolusha et al.
9,072,147 B2 6/2015 Szolusha et al.
9,167,647 B1 10/2015 Takekawa et al.
9,178,427 B1 11/2015 Szolusha
9,577,530 B1 2/2017 Ribarich et al.
9,681,507 B2 6/2017 Lys et al.
9,706,615 B2 7/2017 Seki et al.
(Continued)

OTHER PUBLICATIONS

"U.S. Appl. No. 15/712,779, Non Final Office Action dated Feb. 16, 2018", 6 pgs.

(Continued)

*Primary Examiner* — Thai Pham
(74) *Attorney, Agent, or Firm* — Schwegman Lundberg & Woessner, P.A.

(57) ABSTRACT

Techniques are provided for low, or deep, dimming of a light-emitting diode (LED) load. In an example, a method of adjusting an initial voltage of a driver circuit for an LED load can include providing current to an LED load from a power stage of the driver during an on-time of a pulse-width modulation (PWM) cycle, receiving error current information of the driver circuit at a low-dimming control circuit of the driver, and adjusting a voltage of an output capacitor coupled to the driver during an off-time of the PWM cycle, the charge adjustment based on the error current information.

20 Claims, 5 Drawing Sheets

(56) References Cited

U.S. PATENT DOCUMENTS

| | | | | |
|---|---|---|---|---|
| 9,750,113 | B2 | 8/2017 | Nozawa et al. | |
| 9,814,115 | B2 | 11/2017 | Kido et al. | |
| 2015/0312980 | A1* | 10/2015 | Hu | H05B 33/0815 315/186 |

OTHER PUBLICATIONS

"U.S. Appl. No. 15/712,839, Non Final Office Action dated Feb. 15, 2018", 6 pgs.
"U.S. Appl. No. 15/712,779, Notice of Allowance dated Jul. 6, 2018", 8 pgs.
"U.S. Appl. No. 15/712,779, Response filed May 15, 2018 to Non Final Office Action dated Feb. 16, 2018", 8 pgs.
"U.S. Appl. No. 15/712,839, Examiner Interview Summary dated May 8, 2018", 3 pgs.
"U.S. Appl. No. 15/712,839, Notice of Allowance dated Jun. 22, 2018", 9 pgs.
"U.S. Appl. No. 15/712,839, Response filed May 15, 2018 to Non Final Office Action dated Feb. 15, 2018", 9 pgs.

* cited by examiner

LED DIMMING

TECHNICAL FIELD

This application applies to techniques for Light emitting diode (LED) lighting, including low dimming of LED lighting.

BACKGROUND

Light emitting diode (LED) technology has progressed from providing small visual indicators of electronic operation to becoming a technology applicable to a variety of general lighting applications, including applications for residential, commercial, and outdoor lighting. In general lighting applications, LEDs may perform at or better than prior lighting solutions using a fraction of the energy consumption. However, techniques for efficient dimming of LED lighting to very low dimming settings has been elusive.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Conventional methods of dimming lighting systems of regulating power in DC system can also be applied to LED lighting systems, however, as the dimming set point is lowered, such methods become inefficient or result in undesired flicker of the LEDs. A switching regulator combined with pulse width modulated control can provide efficient dimming of an LED to a certain level using conventional control methods. In such a system, the LED is lit by providing the output of the switching regulator to the LED's via a pulse width modulation (PWM) switch. In certain examples, the switching regulator can supply current for the LED. A PWM switch connects and disconnects the LEDs to the output of the switching regulator. In general, the switching frequency of the regulator is much higher than the PWM frequency which allows for a wide range of dimming control. However, when the on-time, which may sometimes be referred to as duty cycle, of the PWM signal provided by the PWM controller becomes shorter than the switching interval of the regulator needed to transfer sufficient charge to the LED, current control of the LED system can be lost, as well as the ability to further dim the LEDs. When current control is lost due to shortened on-time of the PWM switch cycle, the LEDs can appear to be off or not energized. In some situations, current error can accumulate when the dimming level is very low, then, upon receiving a higher dimming set point, the actual dimming can be too high while the control loop handles the accumulated error.

The present inventors have recognized techniques that allow for low dimming in systems that utilized PWM control without losing current control or inducing flicker of the LED lights. In certain examples, a dimming technique can utilize the PWM "off" time of each PWM cycle to regulate the LED current pulse amplitude of the very short PWM "on" time.

Figure 1:
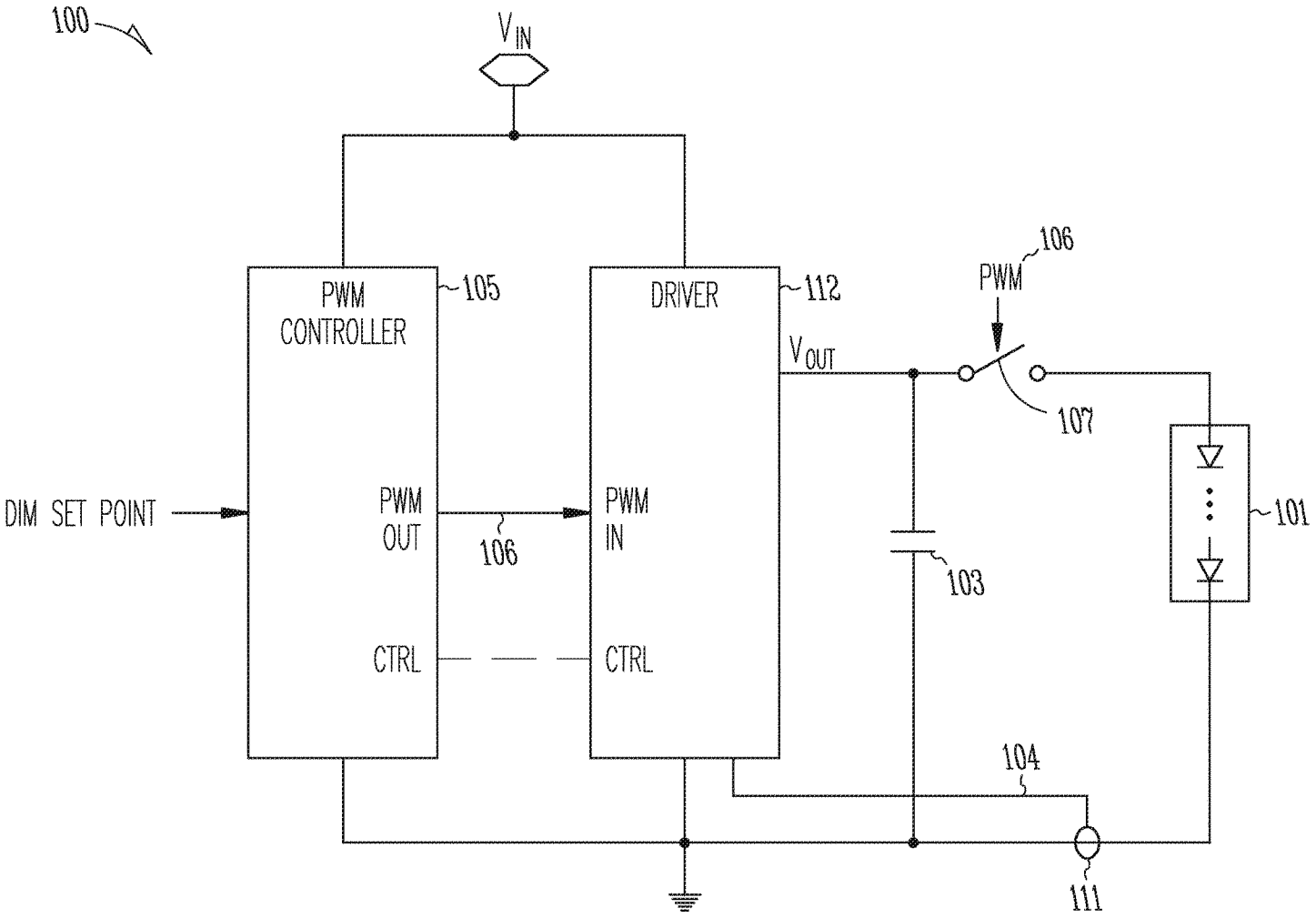
FIG. 1 illustrates generally an example of an LED driver system.

FIG. 1 illustrates generally an example of an LED driver system 100. The system 100 can include a controller circuit, such as a PWM controller 105, an LED driver 112, a PWM switch 107, an output capacitor 103, and a current sensor 111, and can include or be coupled to an LED load 101. The PWM controller 105 can receive an LED dimming set point. The PWM controller 105 can provide a PWM signal 106 having a duty cycle or "on" time that can be adjusted to correspond to the dimming set point. The LED driver 112 can receive the PWM signal and a power supply voltage ($V_{IN}$). The LED driver 112 can include a switched mode or other power regulator such as to regulate an output current or voltage ($V_{OUT}$) to the LED load 101, such that an average current provided to the LED load 101 can be established to be commensurate with the dimming set point. The output capacitor 103 can smooth the output voltage or current of the LED driver 112, and can provide energy storage in cooperation with LED driver 112, such as to allow for very low dimming of the LED load 101 while avoiding flicker. The current sensor 111 can be used by the LED driver 112 to provide closed loop control of the LED current. For example, the current sensor 111 can provide feedback for setting a target value of a peak current of a regulator of the LED driver in certain examples.

Figure 2:
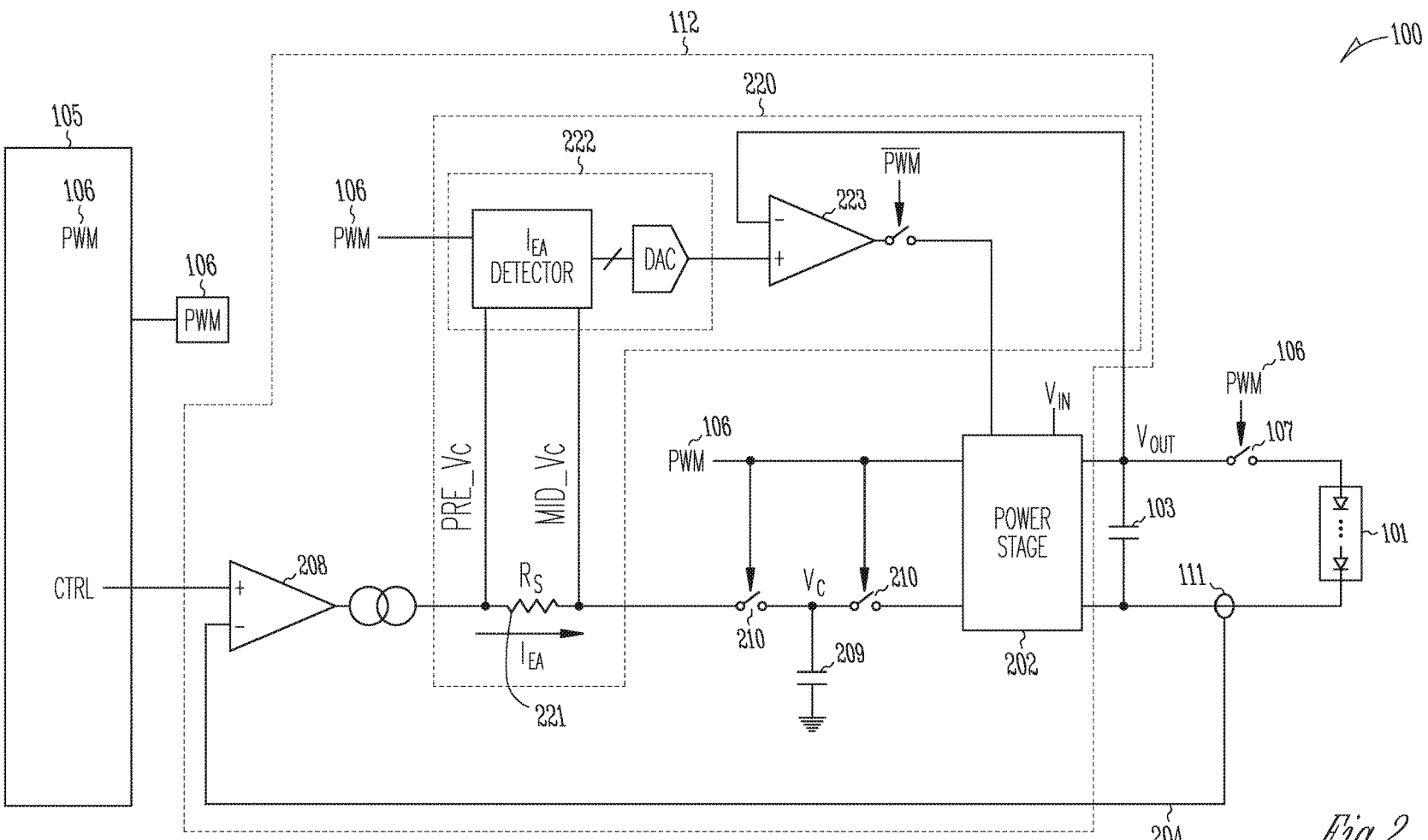
FIG. 2 illustrates generally an example system for low dimming of an LED load.

FIG. 2 illustrates generally an example system 100 for low dimming of an LED load 101. The system 100 can include a LED load 101, a driver 112 including a power stage 202 to provide power to the LED load 101, an output capacitor 103 for smoothing the voltage or current applied to the LED load 101, a feedback loop 204 for controlling current to the LED load 101 during each "on" time of each PWM cycle, and a controller 105. The controller 105 can receive or can be programmed to set or vary a dimming level of the LED load 101. The controller 105 can determine a duty cycle of each PWM cycle and can provide one or more PWM outputs 106 having the proper "on" time associated with the duty cycle. In certain examples, the controller 105 can set a current reference set point (CTRL) for the on-time of each PWM cycle. In some examples, the controller 105 can set the current reference set point (CTRL) at or near a rated maximum of the power stage 202 or the LED load 101.

When a PWM signal to the power stage 202 is active (e.g., during "on" time of a PWM cycle), the power stage 202 can deliver power to the output capacitor 103 and to the LED load 101. The power delivered by the power stage 202 to the LED load 101 can be delivered via a PWM switch 107. The power delivered by the power stage 202 can be regulated to an operating threshold (Vc) received at the power stage 202. In certain examples, the power stage 202 can include an internal clock and current generator that, when enabled, provide current to the output of the power stage 202 in the form of an increasing ramp. When a representation of the level of the current ramp meets the operating threshold (Vc), the current generator can be de-energized. In certain examples, when the current generator is de-energized, current flow can ramp down from the level representative of the operating threshold (Vc) over a discharge period. Upon receiving a clock pulse from the internal clock, the current generator can be energized and can again provide a current at an increasing ramp.

The feedback loop 204 can provide intensity feedback information and can set the operating set point (Vc). The feedback loop 204 can include an error amplifier 208 and a threshold capacitor 209. During each PWM "on" time, the output of the error amplifier 208 and the threshold capacitor 209 are connected to an input of the power stage 202, via one or more PWM switches 210, to provide the operating threshold (Vc). The error amplifier 208, via the LED current sensor 111, can compare the actual current of the LED load 101 to the current reference (CTRL) and can charge or discharge the voltage across the threshold capacitor 209 accordingly. During each PWM "off" time, the threshold capacitor 209 and output of the error amplifier 208 can be isolated from the power stage 202, as well as from each other, via the one or more PWM switches 210.

The above control scheme provides efficient power delivery to the LED load 101 across a wide range of dimming set points. However, when the PWM "on" time becomes very small, the finite response time of the error amplifier 208, the finite response time of the power stage 202, voltage leakage at the output capacitor 103 during the long PWM "off" times, and the limited energy delivery capacity of the power stage 202 for example due to the relative levels of the input and output voltages of the power stage 202, can prevent low dimming of the LED load 101 using power transfer of the power stage 202 only during the PWM "on" time.

In certain examples, the circuit 100 can include a low dimming circuit 220 to extend the dimming capability of the power stage 202 in cooperation with the output capacitor 103. The low dimming circuit 220 can include a current sensor ($R_S$) 221, low dimming control circuit 222, and a voltage error amplifier 223. The current sensor 221 can provide an indication of the current ($I_{EA}$) at the output of the current error amplifier 208. If the current error amplifier 208 was pushing current out during the PWM "on" time, it means the circuit 100 needed more energy transferred to the LED load 101 to reach a steady-state during the PWM "on" time. If the current error amplifier 208 was pulling current in during the PWM "on" time, it means the circuit 100 had too much energy being transferred to the LED load 101 to reach the steady-state during the PWM "on" time. If the current error amplifier 208 was neither pushing nor pulling current, it means the circuit 100 provided the correct amount of energy to reach the steady-state during the PWM "on" time. The low dimming control circuit 220 can use the current error information collected by the current sensor 221 to provide a voltage, or low-dimming, set point for the voltage error amplifier 223. During each PWM "off" time, the voltage error amplifier 223 can compare the voltage set point of the controller 222 of the low dimming circuit 220 to the actual voltage across the output capacitor 103 and can provide a voltage error signal to the power stage 202. During each PWM "off" time, the power stage 202 can be re-enabled or used to charge the output capacitor 103 to a voltage controlled by the voltage error signal from the output of the voltage error amplifier 223. Thus, the output capacitor 103 can be charged, or initialized, to supply a complementary amount of energy, especially during low dimming of the LED load 101, such that the average current provided to the LED load 101 during a subsequent PWM "on" time corresponds to the dimming set point of the circuit 100. In general, the example circuit 100 can use the output current information of the current error amplifier 208 to regulate the output voltage of the power stage 202 across the output capacitor 103 during the PWM "off" time so that the LED load 101 can be biased with the correct voltage at the beginning of the next PWM "on" time.

In certain examples, a PWM switch 107 can connect the output capacitor 103 with the LED load 101 during PWM "on" times and can isolate the output capacitor 103 from the LED load 101 during PWM "off" times. In certain examples, the power stage 202 can be designed to charge or discharge the output capacitor 103 during the PWM "off" time". In some examples, additional logic can re-enable or use the power stage 202, via the PWM input, during the PWM "off" time to allow for charging or discharging of the output capacitor 103.

Figure 3:
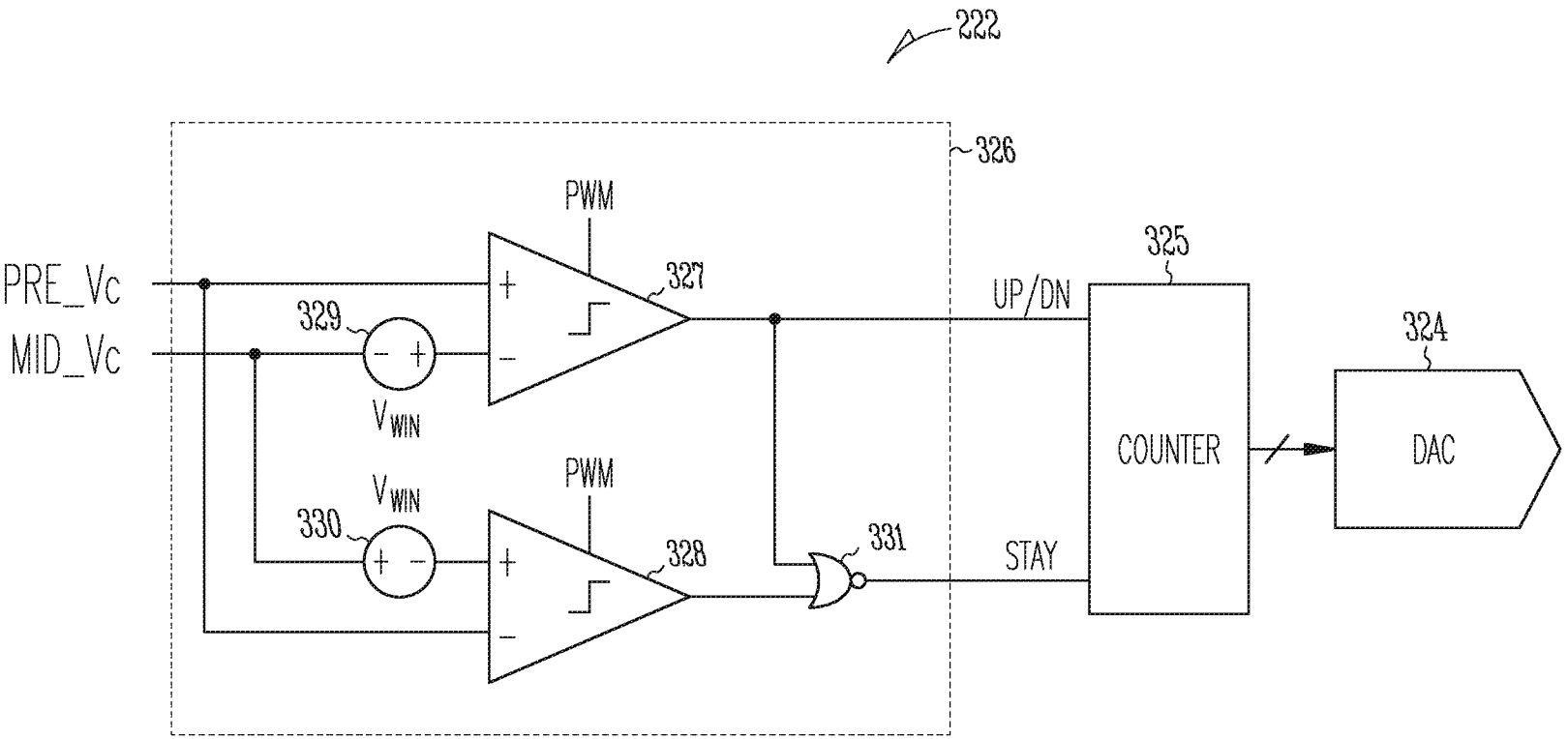
FIG. 3 illustrates generally an example low dimming control circuit.

FIG. 3 illustrates generally an example low dimming control circuit 222. The low dimming control circuit 222 can include a digital-to-analog converter (DAC) 324, a counter 325, and count logic 326. The count logic 326 can receive current information from the current sensor associated with the output of the current error amplifier of the dimming circuit. The count logic 326 can process the current information to control the counter 325. In an example, count logic 326 can include a pair of comparators 327, 328, comparator window voltage references 329, 330, and a logic gate 331, such as a NOR-gate. In certain examples, the comparators 327, 328 can be enabled using the PWM signal (PWM). Depending on the polarity and size of the voltage difference between the outputs (Pre-Vc), (Mid_Vc) of the current sensor as received at the low dimming control circuit 222, one of the comparators 327, 328 may trigger the counter 325 to increment either up or down. If the size of the voltage difference between the outputs (Pre-Vc), (Mid_Vc) of the current sensor as received at the low dimming control circuit 222 is not large enough, as determined by the setting of the comparator window voltage references 329, 330, the value of the counter 325 can remain unchanged. The DAC 324 can receive the digital output of the counter 325 and provide the low-dimming set point of the low dimming control circuit 222.

In certain examples, the low dimming techniques provided herein can be viewed as a way to find a correct initial condition for the LED load current. The techniques allow adjustment of the output voltage of the power stage, via the output capacitor, during the PWM "off" time so that the LED load current can be accurate 30 at the beginning and the early part of the following PWM "on" time. If the PWM "on" time is long enough (i.e., longer than the time constant at the output), the main current feedback loop can regulate the LED current as in conventional LED drivers. In addition, the present subject matter can supplement the LED load regulation performance when the PWM "on" time becomes so short that the main feedback loop can fail to command an accurate LED load current. To do so, the techniques herein can use the PWM "off" time to control additional energy transfer of the output capacitor. Thus, the techniques does not have the limitations of conventional techniques such as finite response speed of the power stage, voltage leakages at the output capacitor, the limited energy delivery capacity of the LED driver power stage set by the relative levels of the supply voltage and output voltage of the power stage, and the maximum input current limit of the power stage 202 during short PWM "on" times.

Figure 4:
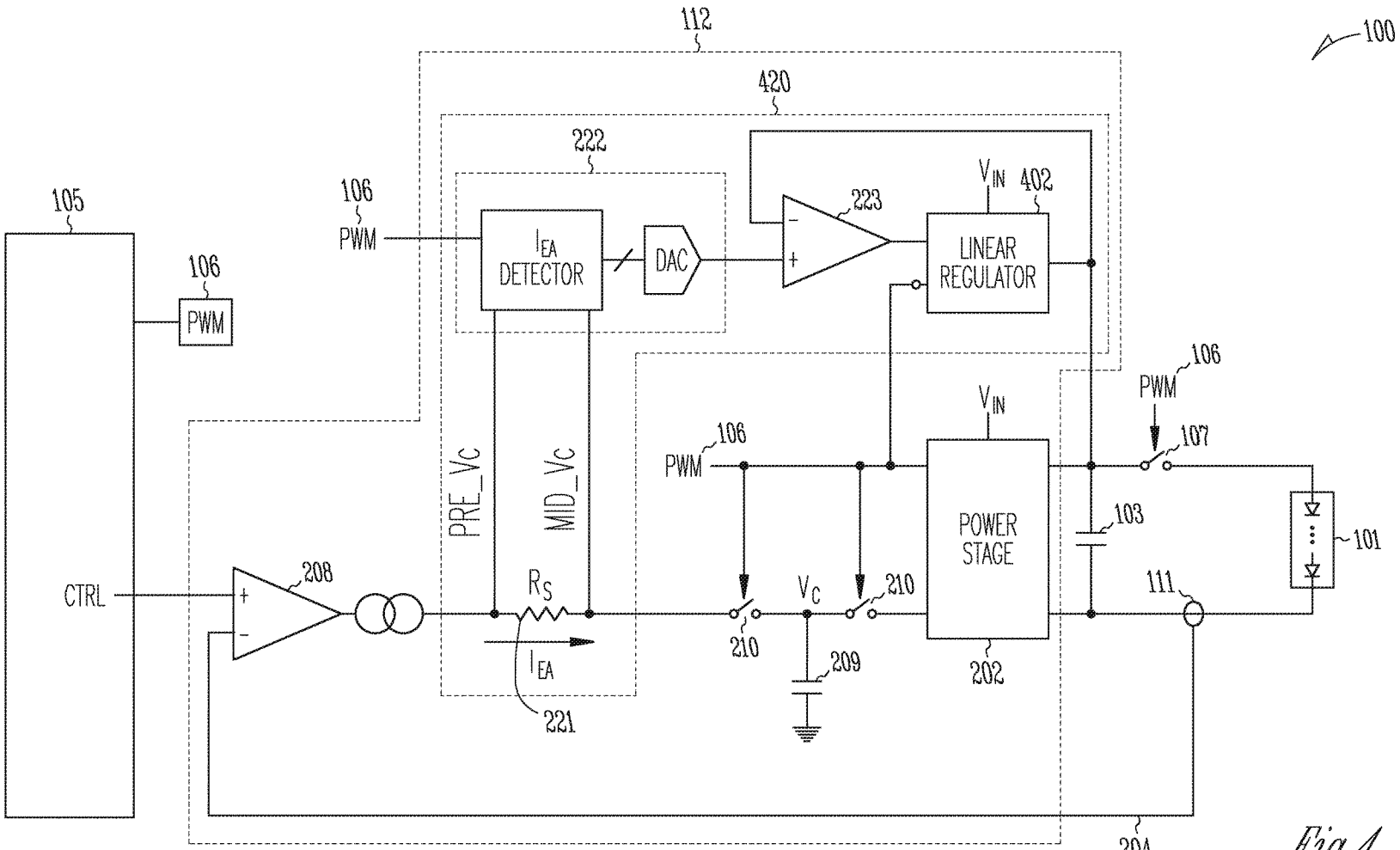
FIG. 4 illustrates generally an example circuit for low dimming of an LED load.

FIG. 4 illustrates generally an example circuit 100 for low dimming of an LED load. The circuit 100 can include a LED load 101, a power stage 202 to provide power to the LED load 101, an output capacitor 103 for smoothing the voltage or current applied to the LED load 101, a feedback loop 204 for controlling current to the LED load 101 during each "on"

time of each PWM cycle, and a controller 105. The controller 105 can receive or can be programmed to set or vary a dimming level of the LED load. The controller 105 can determine a duty cycle of each PWM cycle and can provide one or more PWM outputs 106 having the proper "on" time associated with the duty cycle. In certain examples, the controller 105 can set a current reference set point (CTRL) for the on-time of each PWM cycle. In some examples, the controller 105 can set the current reference set point (CTRL) at or near a rated maximum of the power stage 202 or the LED load 101.

When a PWM input to the power stage 202 is active (e.g., during "on" time of a PWM cycle), the power stage 202 can deliver power to the output capacitor 103 and to the LED load 101. The power delivered by the power stage 202 to the LED load 101 can be delivered via a PWM switch 107. The power delivered by the power stage 202 can be regulated to an operating threshold (Vc) received at the power stage 202. In certain examples, the power stage 102 can include an internal clock and current generator that, when enabled, provide current to the output of the power stage 202 in the form of an increasing ramp. When a representation of the level of the current ramp meets the operating threshold (Vc), the current generator can be de-energized. In certain examples, when the current generator is de-energized, current flow can ramp down from the level representative of the operating threshold (Vc) over a discharge period. Upon receiving a clock pulse from the internal clock, the current generator can be energized and can again provide a current at an increasing ramp.

The feedback loop 204 can set the operating threshold (Vc). The feedback loop 204 can include an error amplifier 208 and a threshold capacitor 209. During each PWM "on" time, the output of the error amplifier 208 and the threshold capacitor 209 are connected to an input of the power stage 202, via one or more switches 210, to provide the operating threshold (Vc). The error amplifier 208, via a LED current sensor 111, compares the actual current of the LED load 101 to the current reference (CTRL) and charges or discharges the voltage across the threshold capacitor 209 accordingly. During each PWM "off" time, the threshold capacitor 209 and output of the error amplifier 208 are isolated from the power stage 202, as well as from each other, via the one or more PWM switches 210.

The above control scheme provides efficient power delivery to the LED load 101 across a wide range of dimming set points. However, when the PWM "on" time becomes very small, the finite response time of the error amplifier 108, the finite response time of the power stage 202, voltage leakage at the output capacitor 103 during the long PWM "off" times, and the limited energy delivery capacity of the power stage 102 for example due to the relative levels of the input and output voltages of the power stage 202, can prevent low dimming of the LED load 101 using power transfer of the power stage 102 only during the PWM "on" time.

In certain examples, the circuit 100 can include a low dimming circuit 420 to extend the dimming capability of the circuit 100 in cooperation with the output capacitor 103. The low dimming circuit 420 can include a current sensor 221, low dimming control circuit 222, a voltage error amplifier 223, and a second power stage 402. The current sensor 221 can provide an indication of the current at the output of the current error amplifier 208. If the current error amplifier 208 was pushing current out during the PWM "on" time, it means the circuit 100 needed more energy transferred to the LED load 101 to reach a steady-state during the PWM "on" time. If the current error amplifier 208 was pulling current in during the PWM "on" time, it means the circuit 100 had too much energy being transferred to the LED load 101 to reach the steady-state during the PWM "on" time. If the current error amplifier 208 was neither pushing nor pulling current, it means the circuit 100 provided the correct amount of energy to reach the steady-state during the PWM "on" time. The low dimming control circuit 420 can use the information collected by the current sensor 221 to provide a voltage set point for the voltage error amplifier 223. During each PWM "off" time, the voltage error amplifier 223 can compare the voltage set point of the dimming control circuit 222 of the low dimming circuit 420 to the actual voltage across the output capacitor 103 and can provide a set point voltage to the second power stage 402. During each PWM "off" time, the second power stage 402 can be enabled to charge the output capacitor 103 to a voltage set by the output of the voltage error amplifier 223. Thus, the output capacitor 103 can be charged, or initialized, to supply a complementary amount of energy, especially during low dimming of the LED load 101, such that the average current provided to the LED load 101 during a subsequent PWM "on" time corresponds to the dimming set point, or intensity set point, of the circuit 100. In general, the example circuit 100 can use the output current information of the current error amplifier 208 to regulate the output voltage of the power stage 202 across the output capacitor 103 during the PWM "off" time so that the LED load 101 can be biased with the correct voltage at the beginning of the next PWM "on" time.

In certain examples, including the examples illustrated in both FIG. 2 and in FIG. 4, current error amplifier 208 can be used momentarily as a comparator. In certain examples, the output of the current error amplifier can be sampled for a short period of time, for example but not limited to, immediately after the PWM switches 210 open. In such an example, the output of the current error amplifier 208 can be sampled to determine if the counter 325 should be incremented up, incremented down or left unchanged. In certain examples, the error current sensor 221 may be able to be eliminated as well as at least a portion of the count logic 326 of the low dimming control circuit 222 when the current error amplifier 208 is used momentarily as a comparator.

In some examples, a separate comparator (not shown) can be used to compare the LED current and the CTRL value. Again, the separate comprator can be enabled for a short period of time, for example but not limited to, right after a 10 PWM falling edge (i.e., beginning of the PWM off time) to determine whether to increment up the counter 325, increment down the counter 325, or leave the counter 325 unchanged. In such an example, the error current sensor 221 and at least a portion of the count logic 326 of the low dimming control circuit 222 may be able to be eliminated.

Figure 5:
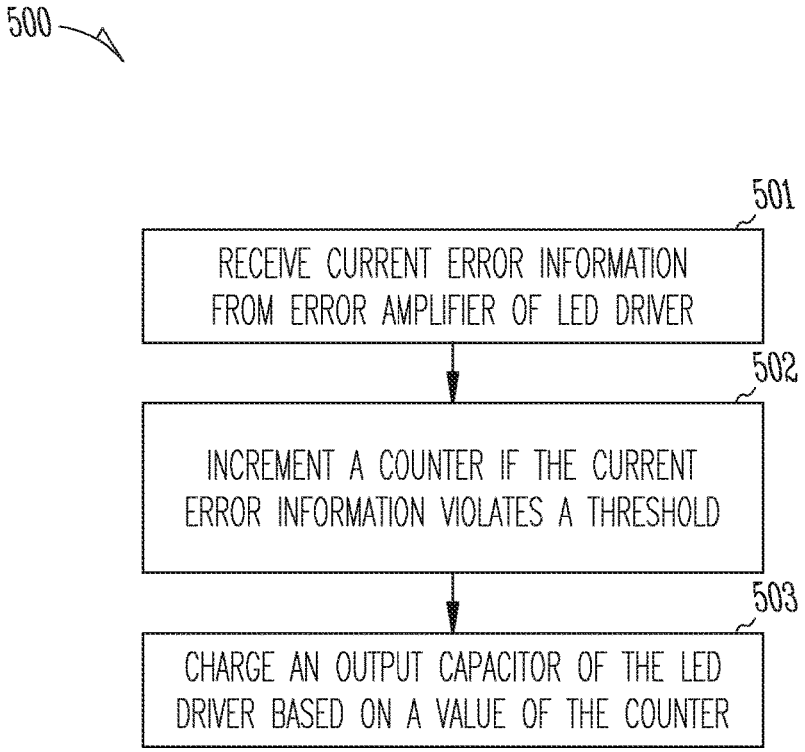
FIG. 5 illustrates generally a flowchart of an example method for providing low dimming of an LED load.

FIG. 5 illustrates generally a flowchart of an example method 500 for providing low dimming of an LED load. At 501, a current detector can receive current, or current flow, error information of a driver of the LED load. In certain examples, a voltage signal can include the current error information and can be sensed using a resistor coupled to the output of an error amplifier of the driver. At 502, a counter can be incremented based on the current error information, for example, when the current error information violates a threshold. In certain examples, if the current error information has a first polarity, the counter can be incremented up. If the current error information has the opposite polarity, the counter can be incremented down. In some examples, the counter may not be incremented if the value of the error information is relatively small, or the absolute value or magnitude of the current error information is less than a threshold. At 503, an output capacitor coupled to an output of the driver can be charged based on the value of the counter. In some examples, the output of the counter can control charging an output capacitor of the driver during "off" times of the PWM cycle. Charging the output capacitor during the "off" time of the PWM cycle can assist in providing, during the "on" time of the PWM cycle, an average current commensurate with the dimming set point that otherwise would not be able to be delivered to the LED load due to structural limitations that inhibit the driver from delivering the requited current during the PWM "on" time. In certain examples, a digital-to-analog converter (DAC) can provide a command signal to driver to control the charging of the output capacitor during the "off" time of the PWM cycle.

In some examples, the same mechanism of the power stage used to provide energy to the LED load during the "on" time of the PWM cycle can be used to charge the output capacitor during the "off" time of the PWM cycle. In some examples, a second mechanism of the power stage separate from the mechanism used to provide energy to the LED load during the "on" time of the PWM cycle can be used to charge the output capacitor during the "off" time of the PWM cycle. In some example the power stage can include a switching regulator such as, but not limited to, a boost regulator, a buck regulator, or a buck-boost regulator. In some examples, a second power stage, or a second mechanism of the power stage, can include, but is not limited to, a linear regulator, a switching regulator, or a charge pump.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. In the event of inconsistent usages between this document and any documents so incorporated by reference, the usage in this document controls.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, the terms "including" and "comprising" are open-ended, that is, a system, device, article, composition, formulation, or process that includes elements in addition to those listed after such a term are still deemed to fall within the scope of subject matter discussed. Moreover, such as may appear in a claim, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like. The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of a claim. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. The following aspects are hereby incorporated into the Detailed Description as examples or embodiments, with each aspect standing on its own as a separate embodiment, and it is contemplated that such embodiments can be combined with each other in various combinations or permutations.

What is claimed is:

1. A driver circuit configured to receive a pulse-width modulation (PWM) signal, and to control a voltage on an output capacitor of the driver circuit that alleviates intensity fluctuation of an LED load during low PWM dimming, the PWM signal configured to include a plurality of PWM cycles, each PWM cycle of the plurality of PWM cycles including an on-time and an off-time, the driver circuit comprising:

a power stage configured to provide current to the output capacitor, and to provide current to an the LED load during the on-time of a PWM cycle of the plurality of PWM cycles via a PWM switch; and a dimming circuit configured to receive error current information from a first error amplifier of the driver circuit during the on-time, and to provide a charge exchange with the output capacitor during the off-time of the PWM cycle, the charge exchange based on the error current information.

2. The driver circuit of claim 1, including the first error amplifier, the first error amplifier configured to receive an LED intensity set point, to receive intensity feedback information from an output of the power stage, and to provide error information for the power stage.

3. The driver circuit of claim 2, wherein the dimming circuit includes a current sensor coupled to an output of the first error amplifier, the current sensor configured to provide the current error information.

4. The driver circuit of claim 3, wherein the dimming circuit is configured to provide a low-dimming set point indicative of a voltage of the output capacitor during the off-time of the PWM cycle.

5. The driver circuit of claim 4, wherein the dimming circuit includes a counter; and wherein the low-dimming control circuit is configured to receive the error current information from the current sensor, to receive a PWM control signal, and to trigger a state of the counter at a transition of the PWM control signal based on the error current information.

6. The driver circuit of claim 5 including a digital-to-analog converter (DAC) configured to receive an output of the counter and to provide the low-dimming set point.

7. The driver circuit of claim 4, including a second error amplifier configured to receive the low-dimming set point and a representation of the voltage of the output capacitor, and to provide a voltage error signal to the power stage.

8. The driver circuit of claim 7, wherein the power stage includes a switching regulator.

9. The driver circuit of claim 8, wherein the power stage includes a linear regulator configured to provide the charge exchange using the voltage error signal.

10. A method of adjusting an initial voltage of a driver circuit, the method comprising:

receiving a pulse-width modulation (PWM) signal at the driver circuit, the PWM signal configured to include a plurality of PWM cycles, each PWM cycle of the plurality of PWM cycles including an on-time and an off-time, providing current to an LED load from a power stage of the driver circuit during the on-time of a PWM cycle of the plurality of PWM cycles;

receiving error current information of the driver circuit at a dimming circuit of the driver circuit; and adjusting a voltage of an output capacitor coupled to the driver circuit during the off-time of the PWM cycle, the charge adjustment based on the error current information.

11. The method of claim 10, wherein providing current to an LED load includes receiving an operating threshold at the power stage.

12. The method of claim 11, wherein receiving the operating threshold includes:

receiving a dimming set point and a representation of current of the LED load at a first error amplifier;

summing the dimming set point and the representation of current of the LED load to provide an error current; and receiving the error current at a threshold capacitor.

13. The method of claim 12, wherein receiving error current information includes receiving a sense voltage at the dimming circuit from a resistor coupled to an output of the first error amplifier.

14. The method of claim 13, wherein adjusting a voltage of an output capacitor includes receiving a low-dimming set point at the power stage, the low-dimming set point indicative of a voltage of the output capacitor during the off-time of the PWM cycle.

15. The method of claim 14, wherein adjusting a voltage of an output capacitor includes adjusting the voltage of the output capacitor during an off-time of the PWM cycle using a switching regulator of the power stage.

16. The method of claim 14, wherein adjusting a voltage of an output capacitor includes adjusting the voltage of the output capacitor during an off-time of the PWM cycle using a linear regulator of the power stage.

17. The method of claim 16, wherein providing current to the LED load includes providing current to the LED load during an on-time of the PWM cycle using a switching regulator of the power stage.

18. The method of claim 14, wherein receiving error current information includes incrementing a counter of the dimming circuit based on the error current information.

19. The method of claim 18, wherein receiving error current information includes not incrementing the counter when a magnitude of the error current information does not violate a threshold.

20. The method of claim 18, wherein adjusting a voltage of an output capacitor includes converting a digital output of the counter to provide the low-dimming set point.

* * * * *